US008033200B2

(12) United States Patent
Johnson et al.

(10) Patent No.: US 8,033,200 B2
(45) Date of Patent: Oct. 11, 2011

(54) UNIVERSAL RATCHETING TOOL

(75) Inventors: Ronald L. Johnson, San Jose, CA (US); Robert J. Gallegos, Fremont, CA (US); Steven Simas Escobar, San Jose, CA (US); Anders Scot Hudson, Campbell, CA (US); Idriss Mansouri-Chafik Ruiz, San Jose, CA (US); Yugen Patrick Lockhart, Palo Alto, CA (US); Howard Allen Wilson, Santa Clara, CA (US); Eric M. Colton, Torrance, CA (US)

(73) Assignee: Wagic, Inc., Los Gatos, CA (US)

( * ) Notice: Subject to any disclaimer, the term of this patent is extended or adjusted under 35 U.S.C. 154(b) by 0 days.

(21) Appl. No.: 12/009,524

(22) Filed: Jan. 17, 2008

(65) Prior Publication Data

US 2009/0183604 A1 Jul. 23, 2009

(51) Int. Cl.
*B25B 13/46* (2006.01)
*B25B 23/16* (2006.01)

(52) U.S. Cl. ..... 81/60; 81/177.2; 81/438

(58) Field of Classification Search ..... 81/436–461, 81/58–58.5, 59.1, 60–63.2, 177.2, 177.85
See application file for complete search history.

(56) References Cited

U.S. PATENT DOCUMENTS

| | | | | |
|---|---|---|---|---|
| 244,309 | A | 7/1881 | Rhodes | |
| 647,528 | A | 4/1900 | Schmidt | |
| 873,363 | A | 12/1907 | Ross | |
| 1,000,900 | A * | 8/1911 | Dorsey | 81/62 |
| 1,006,679 | A | 10/1911 | Rice | |
| 1,172,656 | A | 2/1916 | Yorgensen | |
| 1,337,769 | A | 4/1920 | Hemming | |
| 1,398,583 | A | 11/1921 | Bovee | |
| 1,500,852 | A | 7/1924 | Shepard | |
| 1,502,044 | A | 7/1924 | McCann | |
| 1,530,905 | A | 3/1925 | Nance | |
| 1,559,097 | A | 10/1925 | Hill | |
| 1,753,026 | A | 4/1930 | Rosati | |
| 1,888,222 | A | 11/1932 | Curtis et al. | |
| 1,944,606 | A | 1/1934 | Little | |
| 2,236,333 | A | 3/1941 | Cowles | |
| 2,332,656 | A | 10/1943 | Mirando | 30/22 |
| 2,346,364 | A | 4/1944 | Dowe | 279/83 |
| D142,982 | S | 11/1945 | Bloomfield | |

(Continued)

FOREIGN PATENT DOCUMENTS

| | | |
|---|---|---|
| CA | 1 147 176 | 5/1983 |

(Continued)

*Primary Examiner* — David B Thomas
(74) *Attorney, Agent, or Firm* — Haverstock & Owens LL

(57) ABSTRACT

A universal ratcheting tool provides improved handling of tools that are difficult to use on their own, specifically, hexagonal wrenches. The universal ratcheting tool includes a handle and a body with a ratcheting mechanism within the handle. The body includes a first aperture for receiving a tool, and the first aperture includes slots to accept a plurality of sizes of tools. The body also includes a second aperture where the tool extends out of the body. A retaining component is coupled with the body to retain the tool and a retaining tab is able to be used to open and close the retaining component. Once the tool is positioned and retained within the universal ratcheting tool, a user is able to easily install or remove an object such as a screw with the benefit of a comfortable handle and the ease of use of the ratcheting mechanism.

22 Claims, 8 Drawing Sheets

U.S. PATENT DOCUMENTS

| | | | | | |
|---|---|---|---|---|---|
| 2,409,613 | A | | 10/1946 | Brooks | 306/32 |
| 2,410,971 | A | * | 11/1946 | Hartley | 81/475 |
| 2,465,619 | A | | 3/1949 | Veit | 306/32 |
| 2,475,268 | A | | 7/1949 | Wittle | 279/14 |
| D156,677 | S | | 12/1949 | Smith | D17/14 |
| D157,154 | S | | 2/1950 | Horton | D58/11 |
| 2,509,507 | A | | 5/1950 | Kane | |
| 2,512,967 | A | | 6/1950 | Quiron | 145/50 |
| 2,530,024 | A | | 11/1950 | Moody | 206/17 |
| 2,532,636 | A | | 12/1950 | Minnich | 206/16 |
| 2,569,069 | A | | 9/1951 | Motel | 145/50 |
| 2,590,307 | A | | 3/1952 | Gibson | |
| 2,593,828 | A | | 4/1952 | Arey | 81/177 |
| 2,604,211 | A | | 7/1952 | Steine | |
| 2,701,052 | A | | 2/1955 | Martel | |
| D175,056 | S | | 6/1955 | Wilson | |
| 2,715,028 | A | | 8/1955 | Dossie | 279/9 |
| 2,719,042 | A | | 9/1955 | Epsy | 279/9 |
| 2,778,396 | A | | 1/1957 | Swain | |
| D179,979 | S | | 4/1957 | Noga | |
| 2,800,816 | A | | 7/1957 | Tasciotti | |
| 2,804,970 | A | | 9/1957 | Kuc et al. | 206/16 |
| 2,810,472 | A | | 10/1957 | Midkiff | |
| 2,836,210 | A | | 5/1958 | Garofalo | |
| 2,842,020 | A | | 7/1958 | Tarquinio | 81/177 |
| 2,844,244 | A | | 7/1958 | Hanson | |
| 2,854,741 | A | | 10/1958 | Cholger | |
| 2,878,701 | A | * | 3/1959 | Weersma | 81/438 |
| 3,023,054 | A | | 2/1962 | Shigekuni | |
| 3,061,927 | A | | 11/1962 | Und Ludwigsdorf | 30/156 |
| 3,113,479 | A | | 12/1963 | Swingle | 81/177 |
| 3,222,959 | A | | 12/1965 | Clark | |
| 3,255,792 | A | | 6/1966 | Beck | |
| 3,257,991 | A | | 6/1966 | Mosch | 120/1 |
| D205,745 | S | | 9/1966 | Nannfeldt | D80/9 |
| 3,342,229 | A | | 9/1967 | Janes | |
| 3,424,039 | A | | 1/1969 | Scott | |
| 3,592,086 | A | | 7/1971 | Derwin | 81/177 A |
| 3,667,518 | A | * | 6/1972 | Stillwagon, Jr. | 81/460 |
| 3,802,286 | A | | 4/1974 | Winklhofer et al. | 74/242.11 S |
| 3,863,693 | A | | 2/1975 | Carriker | |
| 3,943,801 | A | | 3/1976 | Yates | 81/71 |
| 3,958,469 | A | | 5/1976 | Meese | |
| 3,997,053 | A | | 12/1976 | Bondhus | |
| 4,000,767 | A | | 1/1977 | Geng | |
| 4,043,230 | A | | 8/1977 | Scrivens | 81/177 A |
| 4,154,125 | A | | 5/1979 | Frank | 74/553 |
| 4,196,761 | A | | 4/1980 | Royer | |
| 4,227,430 | A | | 10/1980 | Jansson et al. | 81/177 M |
| 4,235,269 | A | | 11/1980 | Kraus | |
| 4,238,862 | A | | 12/1980 | Leatherman | |
| 4,241,773 | A | | 12/1980 | Personnat | |
| 4,302,990 | A | | 12/1981 | Chrichton et al. | 81/60 |
| 4,308,770 | A | | 1/1982 | MacDonald | |
| 4,327,790 | A | | 5/1982 | Stevens et al. | |
| 4,384,499 | A | | 5/1983 | Shockley | 81/440 |
| D270,024 | S | | 8/1983 | Strasser | |
| 4,424,728 | A | | 1/1984 | MacDonald | 81/177 |
| 4,448,097 | A | * | 5/1984 | Rocca | 81/177.4 |
| 4,469,109 | A | | 9/1984 | Mehl | |
| 4,476,751 | A | | 10/1984 | Mishima | |
| 4,525,889 | A | | 7/1985 | Dunau | |
| 4,542,667 | A | | 9/1985 | Jang | |
| 4,699,020 | A | | 10/1987 | Bush et al. | |
| 4,703,673 | A | | 11/1987 | Allen | |
| 4,711,353 | A | | 12/1987 | Rozmestor | 206/378 |
| 4,716,795 | A | | 1/1988 | Corona et al. | 81/177.4 |
| 4,716,796 | A | | 1/1988 | Corona et al. | 81/177.4 |
| 4,767,006 | A | | 8/1988 | Wasem | |
| 4,787,276 | A | | 11/1988 | Condon | 81/177.1 |
| 4,815,346 | A | | 3/1989 | Littlehorn | |
| 4,819,523 | A | | 4/1989 | Souza | |
| 4,819,800 | A | | 4/1989 | Wilson | |
| 4,820,090 | A | | 4/1989 | Chen | 408/241 R |
| 4,882,841 | A | | 11/1989 | Margolis | 30/125 |
| 4,926,721 | A | | 5/1990 | Hsiao | 81/177.4 |
| D308,462 | S | | 6/1990 | Komatsu | D8/105 |
| 4,934,223 | A | | 6/1990 | Wong | 81/490 |
| D310,770 | S | | 9/1990 | Zamarripa | |
| 4,960,016 | A | | 10/1990 | Seals | |
| 4,974,477 | A | | 12/1990 | Anderson | |
| 4,979,407 | A | | 12/1990 | Hernandez et al. | 81/3.09 |
| 5,029,707 | A | | 7/1991 | Feng | 206/374 |
| 5,036,975 | A | | 8/1991 | Chow | |
| 5,062,173 | A | | 11/1991 | Collins et al. | 7/118 |
| 5,063,796 | A | | 11/1991 | Gennep | |
| 5,065,487 | A | | 11/1991 | Yother | |
| 5,146,815 | A | | 9/1992 | Scott, III | 81/437 |
| 5,147,038 | A | | 9/1992 | Pergeau | |
| D333,769 | S | | 3/1993 | Jureckson | D8/71 |
| D334,516 | S | | 4/1993 | Tsunoda | D8/29 |
| D339,048 | S | | 9/1993 | Baum | D8/107 |
| 5,263,389 | A | | 11/1993 | Frazell et al. | 81/124.3 |
| 5,265,504 | A | | 11/1993 | Fruhm | 81/439 |
| D342,433 | S | | 12/1993 | Sorenson | D8/107 |
| 5,271,300 | A | | 12/1993 | Zurbuchen et al. | 81/124.4 |
| D343,106 | S | | 1/1994 | Eklind et al. | D8/71 |
| 5,295,422 | A | * | 3/1994 | Chow | 81/124.3 |
| 5,320,004 | A | | 6/1994 | Hsiao | 81/440 |
| 5,329,834 | A | | 7/1994 | Wong | 81/58.3 |
| 5,394,984 | A | | 3/1995 | Aiba | |
| D359,671 | S | | 6/1995 | Acosta | |
| 5,450,774 | A | | 9/1995 | Chang | 81/440 |
| 5,450,775 | A | | 9/1995 | Kozak | 81/440 |
| 5,461,950 | A | | 10/1995 | Iwinski | |
| D365,681 | S | | 1/1996 | Chow | |
| 5,495,942 | A | | 3/1996 | Izhak | 206/372 |
| 5,499,560 | A | * | 3/1996 | Aeschliman | 81/63.2 |
| 5,499,562 | A | | 3/1996 | Feng | 81/177.4 |
| 5,517,885 | A | | 5/1996 | Feng | 81/177.4 |
| 5,522,291 | A | | 6/1996 | Liu | 81/490 |
| 5,535,882 | A | | 7/1996 | Liu | 206/377 |
| D373,943 | S | | 9/1996 | Fuhrmann | D8/71 |
| 5,553,340 | A | | 9/1996 | Brown, Jr. | 7/118 |
| 5,566,596 | A | | 10/1996 | Lin | 81/490 |
| D376,520 | S | | 12/1996 | Morin | D8/14 |
| 5,581,834 | A | | 12/1996 | Collins | 7/118 |
| D377,444 | S | | 1/1997 | Lin | D8/107 |
| 5,592,859 | A | | 1/1997 | Johnson et al. | 81/177.4 |
| D378,797 | S | | 4/1997 | Poremba et al. | D8/107 |
| D380,131 | S | | 6/1997 | Sung | |
| D382,190 | S | | 8/1997 | Blackston et al. | D8/107 |
| D383,048 | S | | 9/1997 | Sorensen et al. | D8/107 |
| 5,662,013 | A | | 9/1997 | Lin | 81/490 |
| D385,172 | S | | 10/1997 | Bramsiepe et al. | D8/83 |
| D386,955 | S | * | 12/1997 | Jones et al. | D8/25 |
| D388,609 | S | | 1/1998 | Chan | |
| 5,711,042 | A | | 1/1998 | Chuang | 7/138 |
| D394,794 | S | | 6/1998 | Vasudeva | D8/107 |
| 5,758,870 | A | | 6/1998 | Weaver | |
| 5,765,247 | A | | 6/1998 | Seber et al. | 7/128 |
| 5,791,211 | A | | 8/1998 | Bondhus et al. | 81/440 |
| 5,803,584 | A | | 9/1998 | Chung | |
| D400,775 | S | | 11/1998 | Hsu | D8/107 |
| 5,855,274 | A | | 1/1999 | Piao | |
| D405,335 | S | | 2/1999 | Lin | D8/82 |
| 5,911,799 | A | | 6/1999 | Johnson et al. | 81/177.4 |
| 5,916,277 | A | | 6/1999 | Dallas | 7/128 |
| 5,918,513 | A | | 7/1999 | Ho | |
| 5,970,828 | A | | 10/1999 | Bondhus et al. | 81/440 |
| D415,946 | S | | 11/1999 | Tsai | D8/107 |
| 5,983,759 | A | | 11/1999 | Turner | |
| 5,992,626 | A | | 11/1999 | Anderson | 206/378 |
| D420,885 | S | | 2/2000 | Lin | D8/107 |
| D426,449 | S | | 6/2000 | Eklind | D8/107 |
| D426,450 | S | | 6/2000 | Eklind | D8/107 |
| D427,875 | S | | 7/2000 | Chiu | D8/105 |
| 6,089,133 | A | | 7/2000 | Liao | |
| 6,092,656 | A | | 7/2000 | Ernst | |
| 6,095,018 | A | | 8/2000 | Schuster | |
| 6,105,767 | A | | 8/2000 | Vasudeva | |
| 6,119,560 | A | | 9/2000 | Anderson et al. | 81/440 |
| 6,128,981 | A | | 10/2000 | Bondhus et al. | 81/440 |
| D433,613 | S | | 11/2000 | Jialin | |
| D433,910 | S | | 11/2000 | Oliver et al. | |
| 6,151,998 | A | | 11/2000 | Fu-Hui | |
| D435,415 | S | | 12/2000 | Johnson et al. | D8/71 |

| | | | | |
|---|---|---|---|---|
| 6,164,172 | A | 12/2000 | Huang | 81/490 |
| D435,773 | S | 1/2001 | Lin | D8/83 |
| D437,541 | S | 2/2001 | Hermansen et al. | D8/105 |
| D437,763 | S | 2/2001 | Oliver et al. | |
| 6,206,189 | B1 | 3/2001 | Huot, Jr. et al. | |
| 6,233,769 | B1 | 5/2001 | Seber et al. | 7/128 |
| 6,237,451 | B1 | 5/2001 | Wei | |
| 6,279,434 | B1 | 8/2001 | Brown | |
| D448,267 | S | 9/2001 | Jean et al. | D8/105 |
| 6,311,587 | B1 | 11/2001 | Johnson et al. | 81/177.4 |
| 6,314,838 | B2 * | 11/2001 | Wall | 81/58.4 |
| 6,318,218 | B1 | 11/2001 | Anderson et al. | |
| 6,332,381 | B1 | 12/2001 | Vasudeva | |
| 6,345,557 | B1 * | 2/2002 | Kuo | 81/177.2 |
| D454,766 | S | 3/2002 | Lin | |
| 6,382,057 | B1 * | 5/2002 | Kienholz | 81/177.2 |
| 6,389,931 | B1 * | 5/2002 | Delaney et al. | 81/60 |
| 6,397,709 | B1 | 6/2002 | Wall | |
| 6,405,620 | B2 | 6/2002 | Liao | |
| D459,967 | S | 7/2002 | Johnson et al. | D8/71 |
| D462,002 | S | 8/2002 | Jean et al. | D8/105 |
| 6,427,564 | B1 | 8/2002 | Nelson | |
| 6,490,954 | B2 | 12/2002 | Johnson et al. | 81/177.4 |
| 6,510,766 | B1 | 1/2003 | Lin | 81/177.4 |
| 6,510,767 | B1 | 1/2003 | Rivera | |
| D472,712 | S | 4/2003 | Sagen | |
| 6,564,680 | B1 | 5/2003 | Rinner et al. | |
| 6,598,503 | B1 | 7/2003 | Cunningham | 81/177.4 |
| D479,963 | S | 9/2003 | Chang | D8/21 |
| 6,675,678 | B2 | 1/2004 | Liu | |
| 6,698,318 | B2 | 3/2004 | Peters | 81/177.4 |
| 6,739,224 | B1 * | 5/2004 | Wershe | 81/437 |
| 6,751,819 | B2 | 6/2004 | Chuang | 7/100 |
| 6,752,046 | B1 * | 6/2004 | Lee | 81/60 |
| 6,758,350 | B2 | 7/2004 | Lin | |
| 6,763,744 | B2 | 7/2004 | Johnson et al. | 81/177.4 |
| D494,438 | S | 8/2004 | Falkenstein et al. | D8/105 |
| 6,799,490 | B1 | 10/2004 | Chu | |
| 6,898,998 | B2 * | 5/2005 | Shyu | 81/63.1 |
| 6,901,826 | B2 * | 6/2005 | Huang | 81/177.2 |
| 6,922,870 | B2 | 8/2005 | Tontz, Sr. | |
| 6,925,910 | B2 | 8/2005 | Alford | |
| 6,928,908 | B1 * | 8/2005 | Yu | 81/490 |
| 6,935,211 | B2 * | 8/2005 | Chen | 81/58.4 |
| 6,941,843 | B2 | 9/2005 | Johnson et al. | 81/177.4 |
| 6,948,406 | B1 * | 9/2005 | Li | 81/63.2 |
| 6,968,758 | B2 * | 11/2005 | Lin | 81/438 |
| D517,391 | S | 3/2006 | Leins | D8/105 |
| 7,028,593 | B1 * | 4/2006 | Lin et al. | 81/439 |
| 7,051,629 | B2 * | 5/2006 | Huang | 81/489 |
| D523,637 | S | 6/2006 | Chang | |
| 7,073,418 | B2 | 7/2006 | Kuo | |
| 7,086,314 | B2 * | 8/2006 | Wannop | 81/490 |
| 7,093,519 | B1 * | 8/2006 | Huang | 81/60 |
| D527,903 | S | 9/2006 | Chan | |
| 7,100,476 | B1 | 9/2006 | Feit | |
| 7,131,358 | B2 * | 11/2006 | Hsien | 81/438 |
| 7,140,280 | B2 | 11/2006 | Hawkins et al. | 81/440 |
| 7,143,669 | B2 * | 12/2006 | Hu | 81/60 |
| 7,150,208 | B2 | 12/2006 | Debley | |
| 7,159,260 | B2 | 1/2007 | Hansen | |
| 7,159,491 | B1 * | 1/2007 | Chaconas et al. | 81/58.1 |
| 7,165,479 | B1 * | 1/2007 | Lee | 81/60 |
| 7,168,345 | B1 | 1/2007 | Hsieh | |
| 7,216,569 | B2 | 5/2007 | Abdelgany | |
| 7,237,463 | B1 | 7/2007 | Lee | |
| D548,464 | S | 8/2007 | Lin | |
| D549,069 | S | 8/2007 | Lin et al. | D8/105 |
| 7,281,454 | B2 | 10/2007 | Johnson et al. | 81/177.4 |
| 7,284,466 | B1 | 10/2007 | Ho | |
| D557,099 | S | 12/2007 | Lin | |
| 7,305,908 | B2 | 12/2007 | Chi et al. | 81/177.4 |
| 7,467,574 | B1 * | 12/2008 | Lin | 81/60 |
| 7,467,575 | B2 | 12/2008 | Lai | |
| 7,565,852 | B2 * | 7/2009 | Yu | 81/177.4 |
| 2003/0047474 | A1 | 3/2003 | Dahlson | |
| 2003/0126957 | A1 * | 7/2003 | Huang | 81/60 |
| 2003/0226428 | A1 | 12/2003 | Liu | |
| 2004/0050218 | A1 | 3/2004 | Napoli | |
| 2004/0173061 | A1 | 9/2004 | Liou | |
| 2004/0262344 | A1 | 12/2004 | White | |
| 2005/0011318 | A1 | 1/2005 | Tsai | |
| 2005/0229752 | A1 | 10/2005 | Nickipuck | |
| 2005/0247587 | A1 | 11/2005 | Holland-Letz | |
| 2005/0268752 | A1 | 12/2005 | Johnson et al. | 81/177.4 |
| 2006/0101955 | A1 | 5/2006 | Chang | 81/490 |
| 2006/0118500 | A1 | 6/2006 | Chen | |
| 2006/0213059 | A1 | 9/2006 | Eggert | 29/857 |
| 2006/0288823 | A1 * | 12/2006 | Schepman | 81/60 |
| 2007/0023306 | A1 | 2/2007 | Lai | |
| 2007/0151402 | A1 | 7/2007 | Schneeman et al. | |
| 2007/0221017 | A1 | 9/2007 | Heaven | |
| 2007/0245862 | A1 * | 10/2007 | Gonzalez et al. | 81/439 |
| 2007/0295171 | A1 | 12/2007 | Johnson et al. | |
| 2008/0128370 | A1 | 6/2008 | Shih | |
| 2008/0148909 | A1 | 6/2008 | Lai | |
| 2008/0156754 | A1 | 7/2008 | Cheng | |
| 2008/0164171 | A1 | 7/2008 | Meng | |
| 2008/0190249 | A1 * | 8/2008 | Yu | 81/177.4 |
| 2008/0202963 | A1 | 8/2008 | Liao | |
| 2008/0251402 | A1 | 10/2008 | Chiu | |
| 2008/0271573 | A1 * | 11/2008 | Lown et al. | 81/3.45 |
| 2009/0107303 | A1 * | 4/2009 | Steinweg et al. | 81/177.85 |
| 2009/0241740 | A1 | 10/2009 | Heagerty | |

FOREIGN PATENT DOCUMENTS

| | | | | |
|---|---|---|---|---|
| DE | 24 53 480 | A1 | 5/1976 | |
| DE | 37 44 176 | A1 | 8/1989 | |
| EP | 503 559 | A1 | 9/1992 | |
| EP | 618 046 | A1 | 10/1994 | |
| FR | 787512 | | 9/1935 | 5/4 |
| GB | 856223 | | 12/1960 | |
| JP | 55-045442 | U | 3/1980 | |
| JP | 57-13165 | | 1/1982 | |
| JP | 3-47775 | | 5/1991 | |
| JP | 4-29368 | | 3/1992 | |
| JP | 5-31882 | | 4/1993 | |
| WO | WO 83/01406 | | 4/1983 | |
| WO | WO 97/29887 | | 8/1997 | |

* cited by examiner

UNIVERSAL RATCHETING TOOL

FIELD OF THE INVENTION

The present invention relates to the field of hand held tools. More specifically, the present invention relates to the field of hexagonal wrenches and related tools and safety, comfort, and convenience of accessories and tools.

BACKGROUND OF THE INVENTION

Hexagonal wrenches or tool drivers, also referred to as allen wrenches or L-wrenches, have a hexagonal L-shaped body, including a long leg member and a short leg member. The end of either leg member is able to be inserted into a head of a screw or tool designed to accept a hexagonal wrench. Once inserted, rotational pressure is applied to the hexagonal wrench in order to tighten or loosen the screw. The leg members of the hexagonal wrench are designed to be of different lengths in order to allow a user flexibility when using the wrench in different environments and situations. For example, in a narrow, confined environment, the long leg of the hexagonal wrench is inserted into the head of the screw and the user will apply rotational pressure to the short leg. Or, if the environment is not so confined, the user is able to insert the short leg of the hexagonal wrench into the head of the screw and apply rotational pressure to the long leg.

Hexagonal wrenches are manufactured and distributed in multiple English and metric sizes in order to facilitate their use with screw heads of multiple sizes. Such wrenches are usually sold in a set which includes wrenches of multiple sizes but are also distributed individually.

When using a hexagonal wrench, a user, will insert an end of the hexagonal wrench into the head of a workpiece such as a screw, and will then exert rotational pressure on the opposite end of the wrench in order to tighten or loosen the screw. Because of the size and dimensions of the hexagonal wrench it is particularly difficult to exert a great amount of rotational pressure on the hexagonal wrench when the long leg of the hexagonal wrench is inserted into the head of the screw. Because the hexagonal wrench is typically turned with the user's fingers, the user is able to also experience scrapes and cuts from the use of hexagonal wrenches in this manner. Ingenuitive users have also used other tools, including vice grips, pliers and the like, to turn hexagonal wrenches. However, this method is disadvantageous because such tools are able to lose their hold on the hexagonal wrench when rotational pressure is applied or are able to even bend or otherwise disfigure the hexagonal wrench.

SUMMARY OF THE INVENTION

A universal ratcheting tool provides improved handling of tools that are difficult to use on their own, specifically, hexagonal wrenches. The universal ratcheting tool includes a handle and a body with a ratcheting mechanism within the handle. The body includes a first aperture for receiving a tool, and the first aperture includes slots to accept a plurality of sizes of tools. The body also includes a second aperture where the tool extends out of the body. A retaining component is coupled with the body to retain the tool and a retaining tab is able to be used to open and close the retaining component. Once the tool is positioned and retained within the universal ratcheting tool, a user is able to easily install or remove an object such as a screw with the benefit of a comfortable handle and the ease of use of the ratcheting mechanism.

In one aspect, a device comprises a handle including a first segment and a second segment, an aperture within the second segment, the aperture configured for receiving a tool, a retaining component coupled to the body for retaining the tool and a ratcheting mechanism within the handle for enabling ratcheting movements. The device further comprises one or more directional tabs for configuring orientation of the ratcheting mechanism. The device further comprises a retaining tab for opening and closing the retaining component. The aperture includes a plurality of slots configured for receiving a plurality of sizes of tools. The retaining component includes at least one arm for retaining the tool. The first segment of the handle is a hand-held size. The tool includes an elongated rod having a bend through a predetermined angle and including a proximal end for engaging an object, and a mounting end between the bend and a distal end.

In another aspect, a device comprises a handle component, a body component coupled with the handle component, an aperture within the body component, the aperture configured for receiving a plurality of sizes of tools, a retaining component coupled with the body component for retaining a tool of the plurality of sizes of tools and a ratcheting mechanism within the handle component for enabling ratcheting movements. The device further comprises one or more directional tabs for configuring orientation of the ratcheting mechanism. The device further comprises a retaining tab for opening and closing the retaining component. The aperture includes a plurality of slots configured for receiving the plurality of sizes of tools. The retaining component includes at least one arm for retaining the tool. The handle component is a hand-held size. The tool includes an elongated rod having a bend through a predetermined angle and including a proximal end for engaging an object, and a mounting end between the bend and a distal end.

In another aspect, a device comprises a handle component sized for a person's hand, a ratcheting mechanism within the handle component for enabling ratcheting movements, a body component coupled with the handle component, a first aperture within the body component, the first aperture configured with a plurality of slots to receive a plurality of sizes of tools, a second aperture within the body component, the second aperture configured to allow a tool of the plurality of sizes of tools to extend out of the body component, a retaining component coupled with the body component for retaining the tool and a retaining tab for opening and closing the retaining component. The device further comprises one or more directional tabs for configuring orientation of the ratcheting mechanism. The retaining component includes at least one arm for retaining the tool. The tool includes an elongated rod having a bend through a predetermined angle and including a proximal end for engaging an object, and a mounting end between the bend and a distal end.

In yet another aspect, a method of utilizing a universal ratcheting tool comprises positioning a tool within a first aperture of the universal ratcheting tool, the tool extending through a second aperture of the universal ratcheting tool, retaining the tool within the universal ratcheting tool and turning the universal ratcheting tool while the tool is inserted into an object. The method further comprising configuring an orientation of the universal ratcheting tool before turning the universal ratcheting tool. Retaining the tool within the universal ratcheting tool is implemented with a retaining component. The first aperture includes a plurality of slots configured for receiving a plurality of sizes of tools. The tool includes an elongated rod having a bend through a predetermined angle and including a proximal end for engaging an object, and a mounting end between the bend and a distal end.

DETAILED DESCRIPTION OF THE PREFERRED EMBODIMENT

A universal ratcheting tool provides an improved handle for turning a tool such as a hexagonal wrench.

Figure 1:
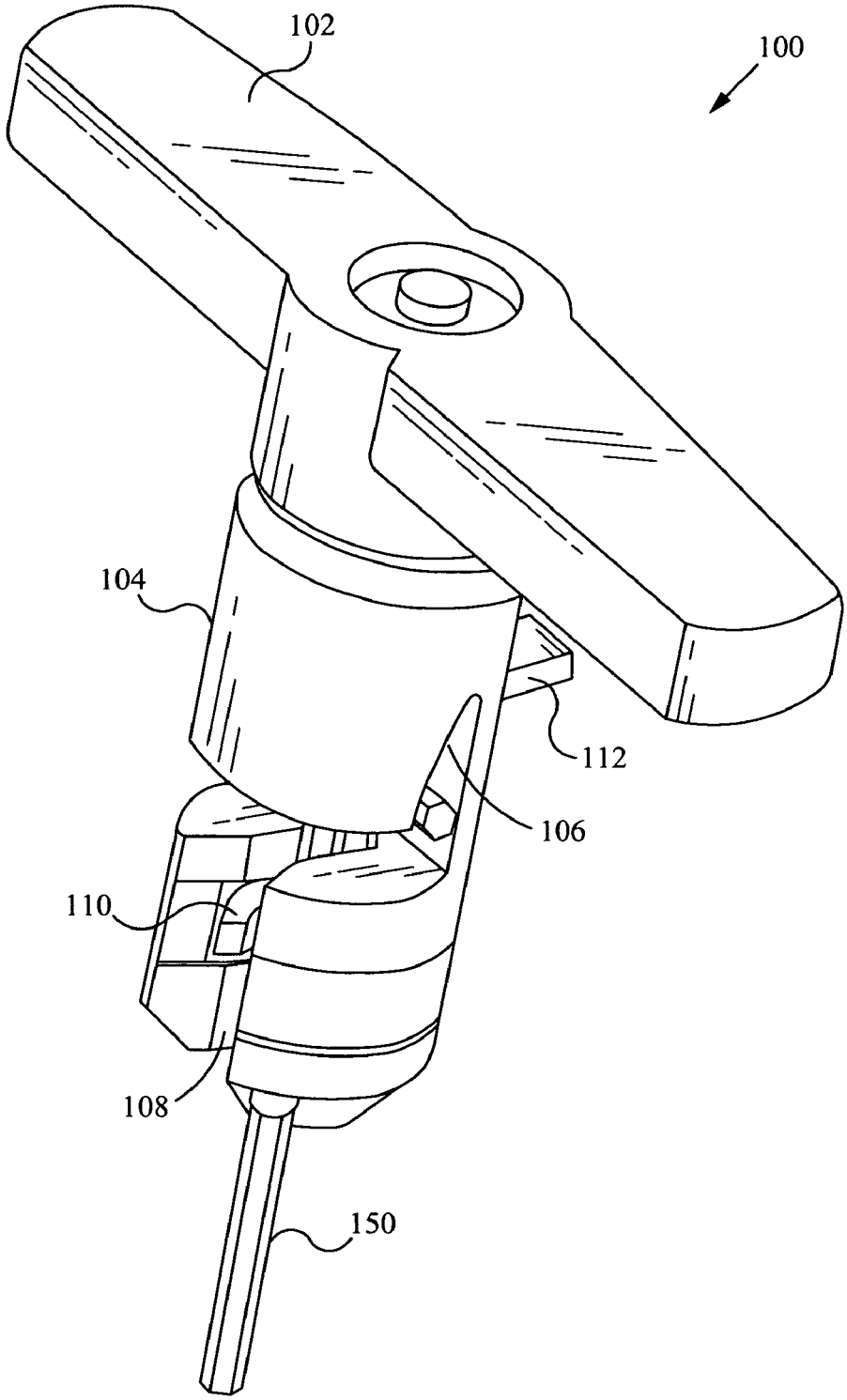
FIG. 1 illustrates a top-side perspective view of a universal ratcheting tool with a tool inserted in accordance with the apparatus of the present invention.

FIG. 1 illustrates a top-side perspective view of a universal ratcheting tool 100 with a tool 150 inserted in accordance with the apparatus of the present invention. In some embodiments, the tool 150 is a hexagonal wrench. The universal ratcheting tool 100 includes a handle component 102 coupled with a body component 104. The handle component 102 is able to be any size, shape or configuration. In some embodiments, the size and shape is such that a user is able to grip the handle with a single hand. The body component 104 includes a first aperture 106. In some embodiments, the first aperture 106 is shaped to universally receive tools of different sizes. The shape of the first aperture 106 is such that the top of the first aperture 106 is able to receive a small tool, the bottom of the first aperture 106 is able to receive a large tool and the middle of the first aperture 106 is able to receive tools sized between small and large. In some embodiments, the first aperture 106 has distinct slots which are each able to receive a correspondingly-sized tool. The body 104 also includes a second aperture 108 to allow the opposite end of the tool 150 to protrude out of the bottom of the universal ratcheting tool 100. A retaining component 110 retains the tool 150 to prevent the tool 150 from falling out of the universal ratcheting tool 100. The retaining component 110 is implemented in any way to prevent the tool 150 from falling out, but in some embodiments, the retaining component 110 includes at least one arm, preferably two arms, which close around the tool 150. To open and close the retaining component 110, a retaining tab 112 is utilized, in some embodiments. The retaining tab 112 includes a pointed end which pushes the retaining component 110 closed when pushed down. In some embodiments, the retaining component 110 is spring-loaded so that the retaining component 110 is in an open position unless the retaining tab 112 is positioned to close the retaining component 110. In some embodiments, the retaining component 110 is spring-loaded so that the retaining component 110 is in a closed position unless the retaining tab 112 is positioned to open the retaining component 110.

When inserted into the first aperture 106 and the second aperture 108 of the body 104, the tool 150 is positioned in the appropriately sized slot with the short leg or mounting end of the tool 150 positioned in the slot and the long leg of the tool 150 extending through the second aperture 108 formed through a bottom of the body 104. The tool 150 includes an elongated rod having a bend through a predetermined angle. A proximal end of the tool 150 is for engaging an object such as a screw which is driven by the tool 150. The short leg member or mounting end of the tool 150 extends from the bend to a distal end.

Figure 2:
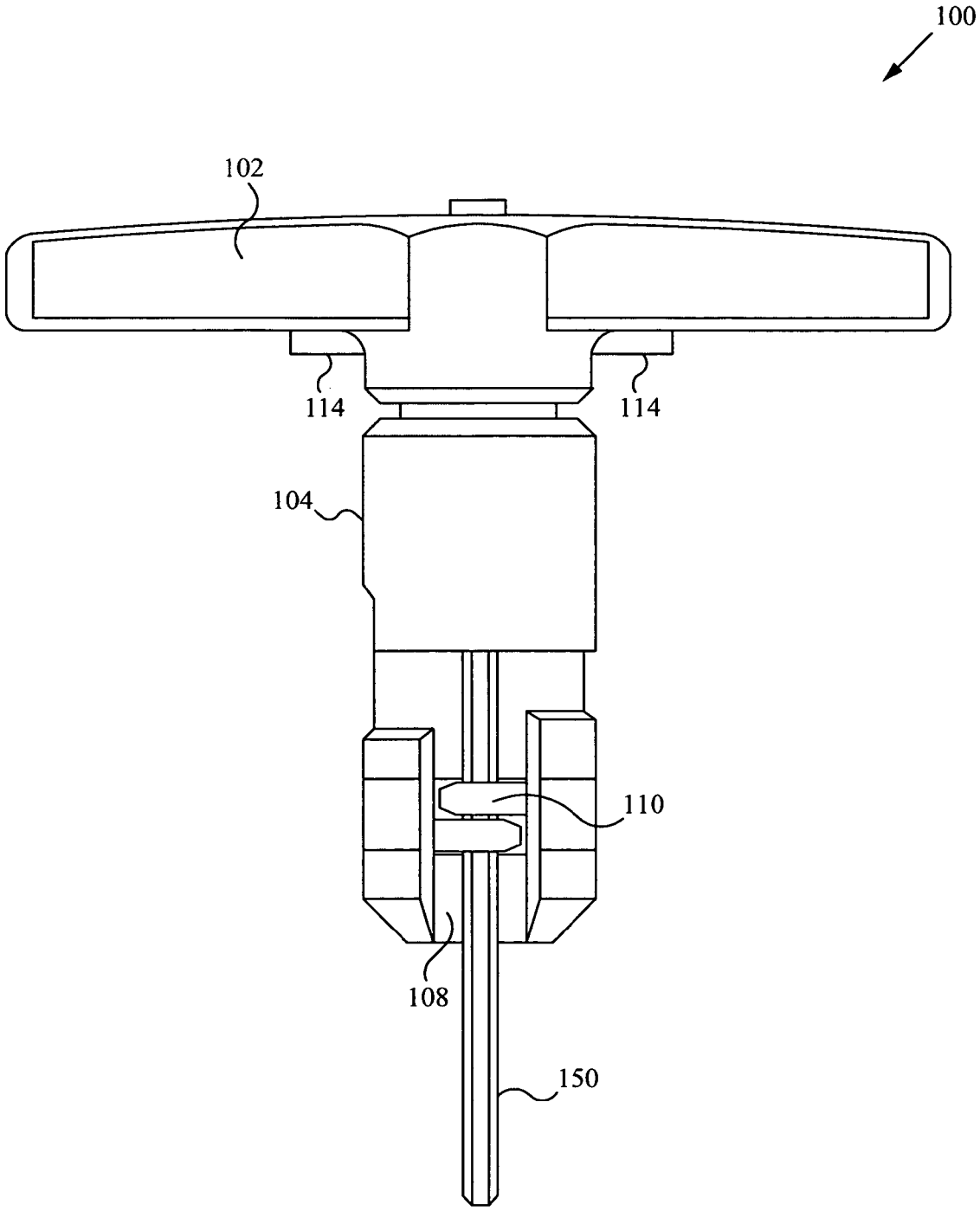
FIG. 2 illustrates a front view of a universal ratcheting tool including a tool in accordance with the apparatus of the present invention.

FIG. 2 illustrates a front view of a universal ratcheting tool 100 including a tool 150 in accordance with the apparatus of the present invention. As described above, the universal ratcheting tool 100 includes a handle component 102 and a body component 104. The body component 104 includes a first aperture 106 (FIG. 1) which is where the short leg or mounting end of the tool 150 is positioned, and a second aperture 108 which is where the long leg of the tool 150 extends through. A retaining component 110 retains the tool 150 within the body 104 when the retaining component 110 is in a closed configuration as shown. Directional tabs 114 enable selection of which way an internal ratcheting mechanism 116 (FIG. 5) functions, thus allowing a user to use the universal ratcheting tool to tighten and loosen objects.

Figure 3:
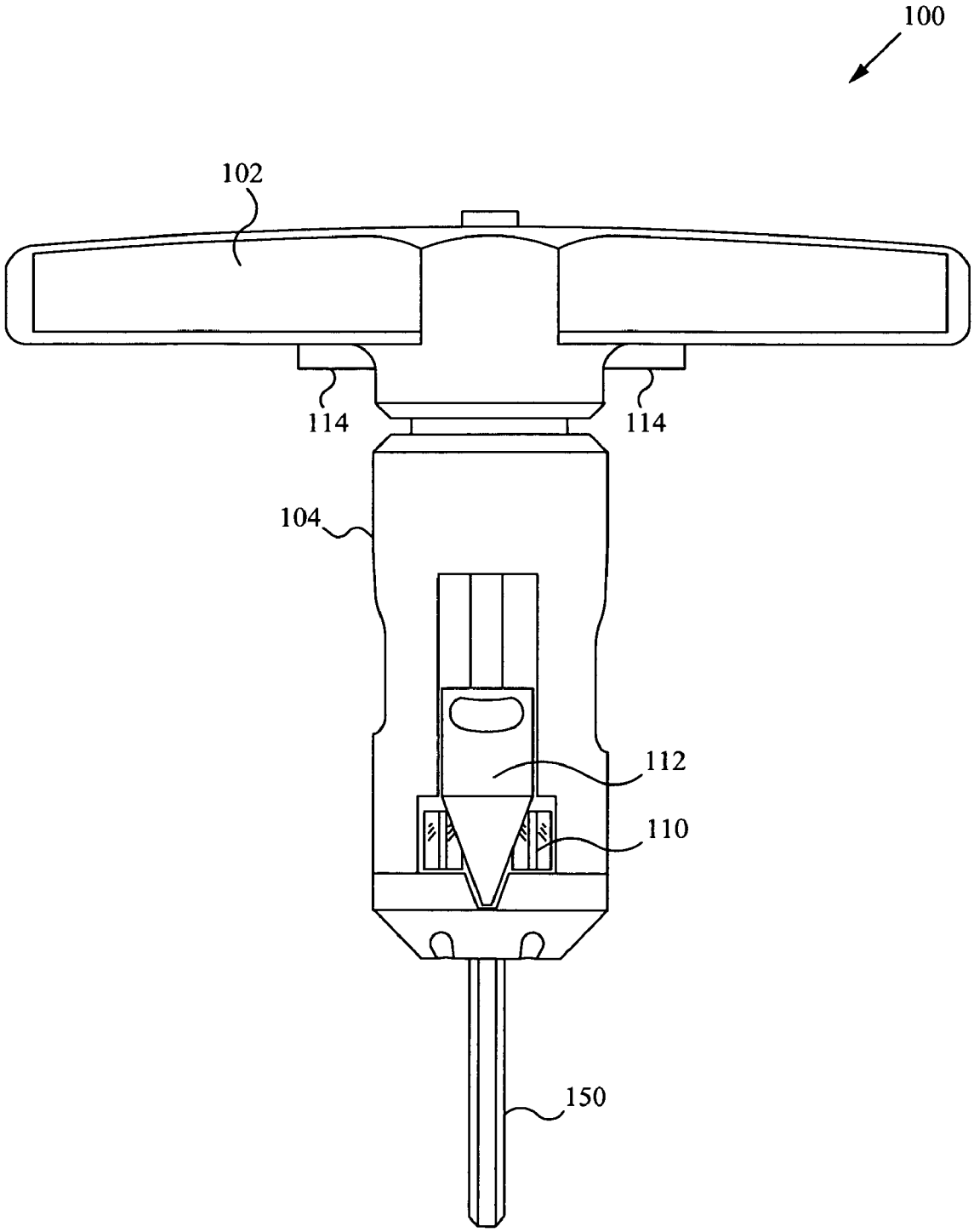
FIG. 3 illustrates a back view of a universal ratcheting tool including a tool in accordance with the apparatus of the present invention.

FIG. 3 illustrates a back view of a universal ratcheting tool 100 including a tool 150 in accordance with the apparatus of the present invention. The universal ratcheting tool 100 includes a handle component 102 and a body component 104. The universal ratcheting tool 100 also includes a retaining tab 112 coupled with the body component 104. The retaining tab 112 is able to slide up and down to open and close a retaining component 110 which retains the tool 150. As shown, the retaining tab 112 is in the down position and the pointed end of the retaining tab 112 pushes the back of the retaining component apart which, in turn, closes the retaining component around the tool 150. In some embodiments, the retaining component 110 and the retaining tab 112 are configured so that when the retaining tab 112 is pushed down into the retaining component 110, the retaining component 110 opens. As described above, directional tabs 114 enable selection of which way the ratcheting mechanism 116 (FIG. 5) functions.

Figure 4A:
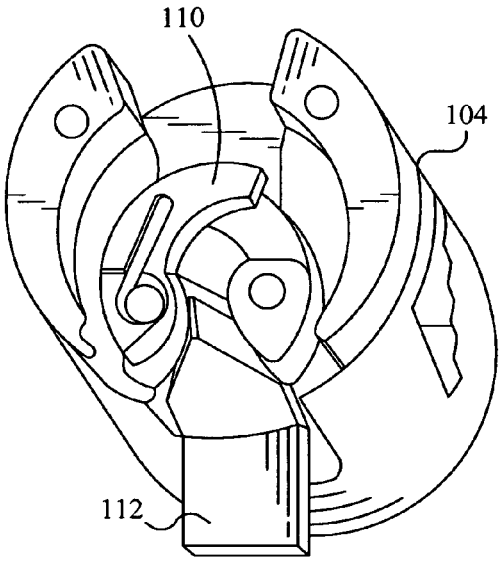
FIG. 4A illustrates a bottom view of part of the body of the universal ratcheting tool with the retaining component and the retaining tab in a closed position in accordance with the apparatus of the present invention.

FIG. 4A illustrates a bottom view of part of the body 104 of the universal ratcheting tool 100 with the retaining component 110 and the retaining tab 112 in a closed position in accordance with the apparatus of the present invention. When the retaining tab 112 is down or in a direction for closing, the retaining component 110 is closed. In some embodiments, the retaining tab 112 works by having a pointed end protrude between the backs of the arms of the retaining component 110 which pushes the fronts of the arms closer together.

Figure 4B:
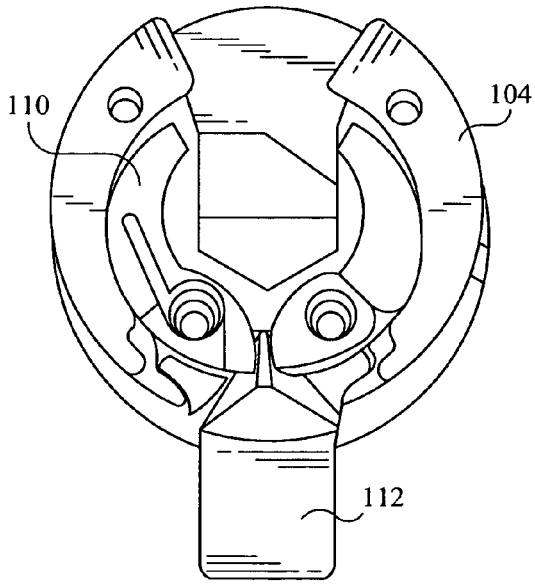
FIG. 4B illustrates a bottom view of part of the body of the universal ratcheting tool with the retaining component and the retaining tab in an open position in accordance with the apparatus of the present invention.

FIG. 4B illustrates a bottom view of part of the body 104 of the universal ratcheting tool 100 with the retaining component 110 and the retaining tab 112 in an open position in accordance with the apparatus of the present invention. When the retaining tab 112 is up or in a direction for opening, the retaining component 110 is open. In some embodiments, the retaining component is spring-loaded which causes the arms to open when the retaining tab 112 is not pushing them closed.

Figure 5:
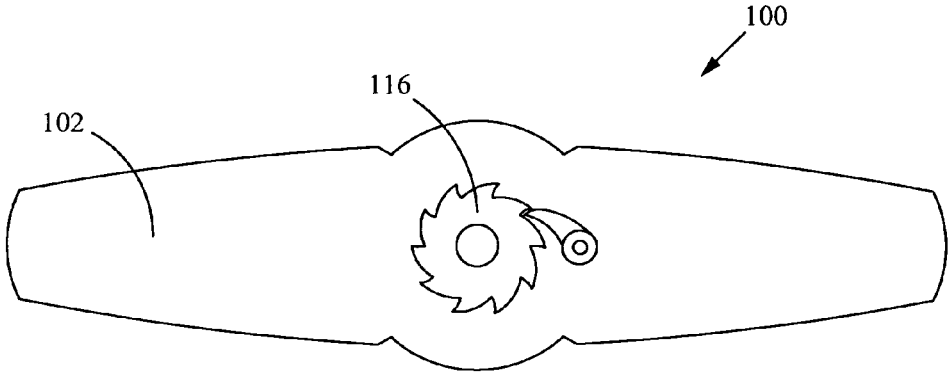
FIG. 5 illustrates a cross sectional view of a universal ratcheting tool including a ratcheting mechanism in accordance with the apparatus of the present invention.

FIG. 5 illustrates a cross sectional view of a universal ratcheting tool 100 including a ratcheting mechanism 116 in accordance with the apparatus of the present invention. The ratcheting mechanism 116 is located within the handle 102, the body 104 and/or any other appropriate part of the universal ratcheting tool 100. The ratcheting mechanism 116 is implemented as any ratcheting mechanism known in the art. Ratchets work generally by having a form of gear wheel that, instead of having regular teeth, has teeth set off at an angle, and a stiff, thin protrusion referred to as a pawl that rests against the gear wheel. When the gear wheel is rotated in one direction, the protrusion raises and clicks back in place. Because of the shape of the gear wheel it is difficult to push the protrusion back and over the tooth of the gear. Alternatively, this gear wheel can be set in a molding shaped to admit rotation of this gear wheel in one direction only. If the gear wheel is rotated backwards, the molding and the teeth will clash. By implementing a ratcheting mechanism, a user does not have to continuously turn, remove his hand from the handle, place his hand on the handle again, turn and so forth. The ratcheting mechanism enables the user to continuously keep his hand on the handle and simply turn the handle back and forth similar to other ratcheting tools. In some embodiments, the ratcheting tool 100 is configured so that the moveable direction of the handle is configurable. For example, the handle is able to be configured to turn a tool clockwise or counterclockwise.

Figure 6:
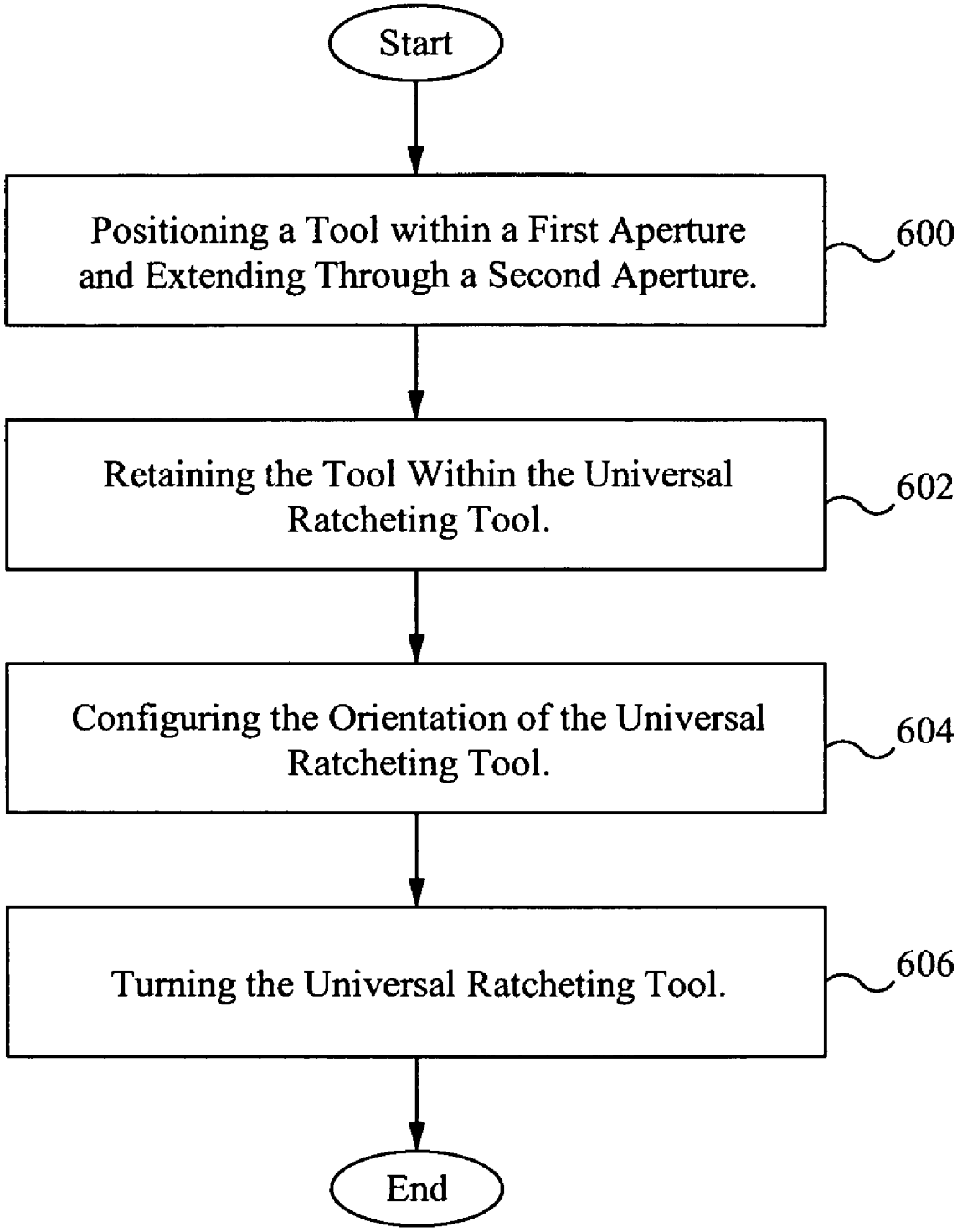
FIG. 6 illustrates a flowchart of a method of utilizing the universal ratcheting tool in accordance with the apparatus of the present invention.

FIG. 6 illustrates a flowchart of a method of utilizing the universal ratcheting tool in accordance with the apparatus of the present invention. In the step 600, a tool is positioned within the first aperture and extending through the second aperture. Specifically, the tool is positioned within the corresponding slot within the first aperture. In the step 602, the tool is retained within the universal ratcheting tool by closing the retaining component using the retaining tab. In some embodiments, the retaining component is closed in another way such as without a retaining tab. If desired or necessary, the ratcheting mechanism orientation is configured so that the universal ratcheting tool is able to tighten or loosen an object, in the step 604. The step 604 is able to be performed at any time before the step 606, and in embodiments where the ratcheting mechanism is not configurable, the step 604 is skipped. After positioning the tool into an object such as a screw, the handle is turned to tighten or loosen the object, in the step 606. To remove or replace the tool, reverse steps are taken including opening the retaining component and removing the tool from the first and second apertures.

Figure 7A:
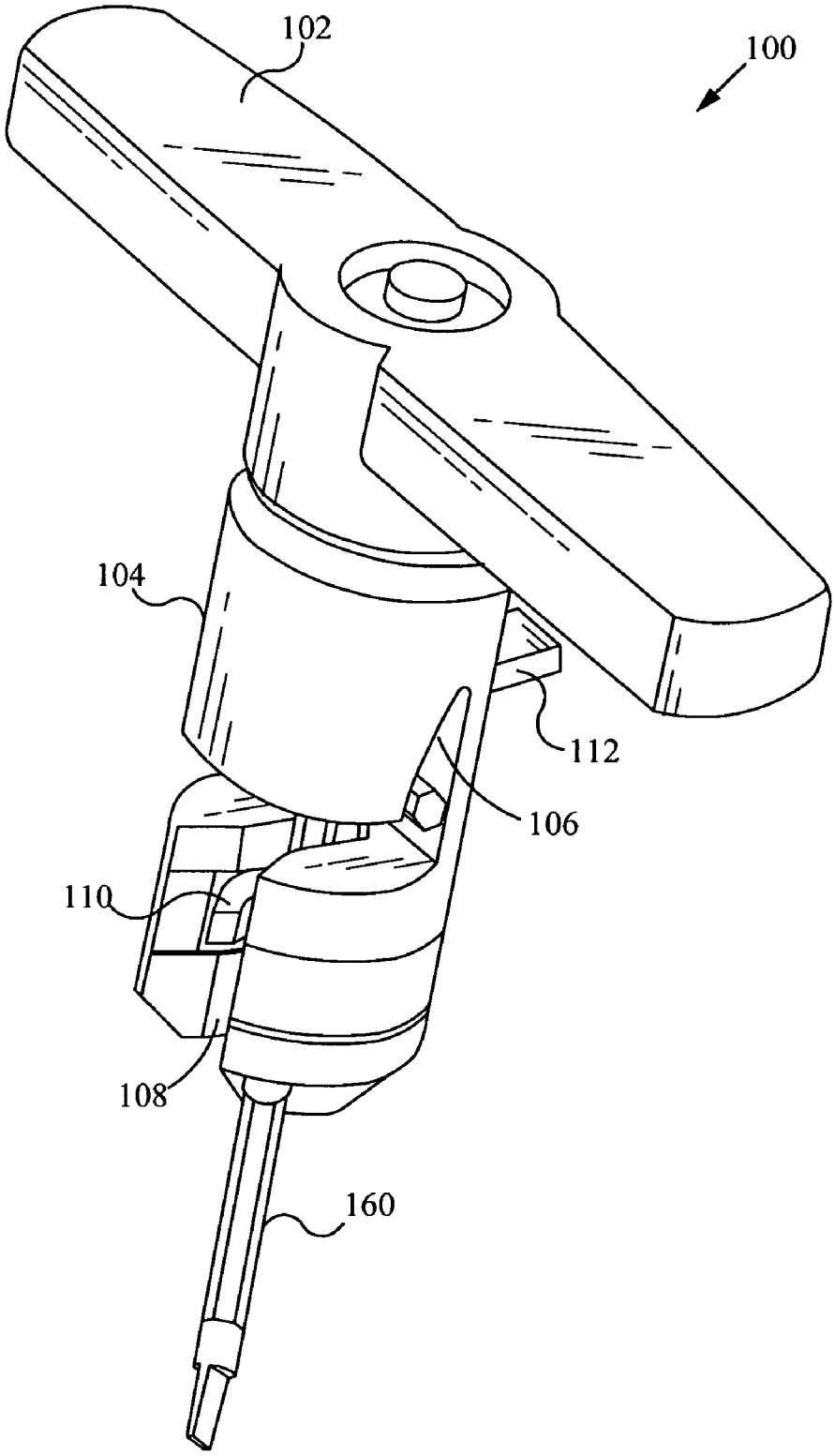
FIG. 7A illustrates a flathead screwdriver with the universal ratcheting tool in accordance with the apparatus of the present invention.
Figure 7B:
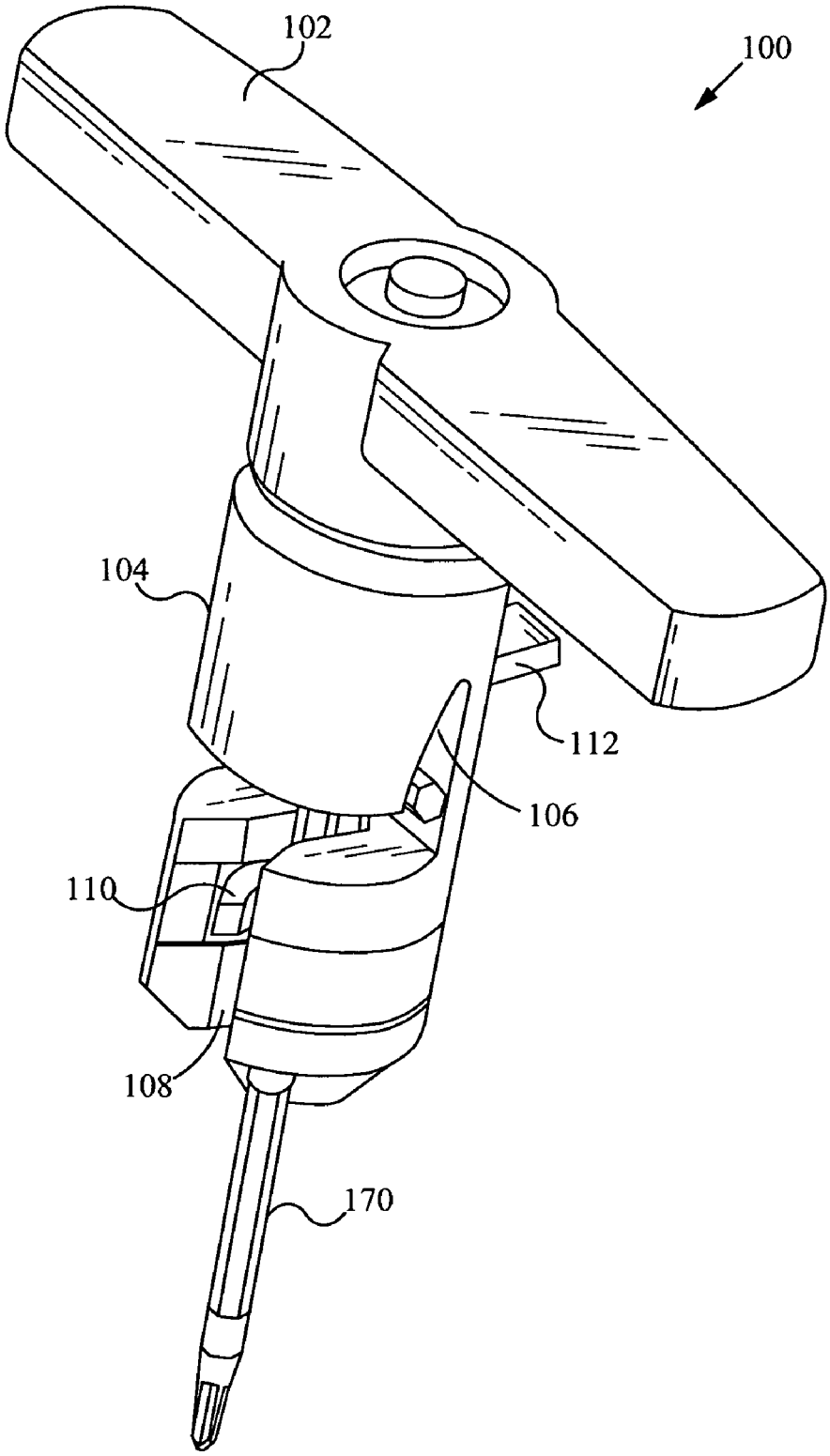
FIG. 7B illustrates a phillips screwdriver with the universal ratcheting tool in accordance with the apparatus of the present invention.
Figure 7C:
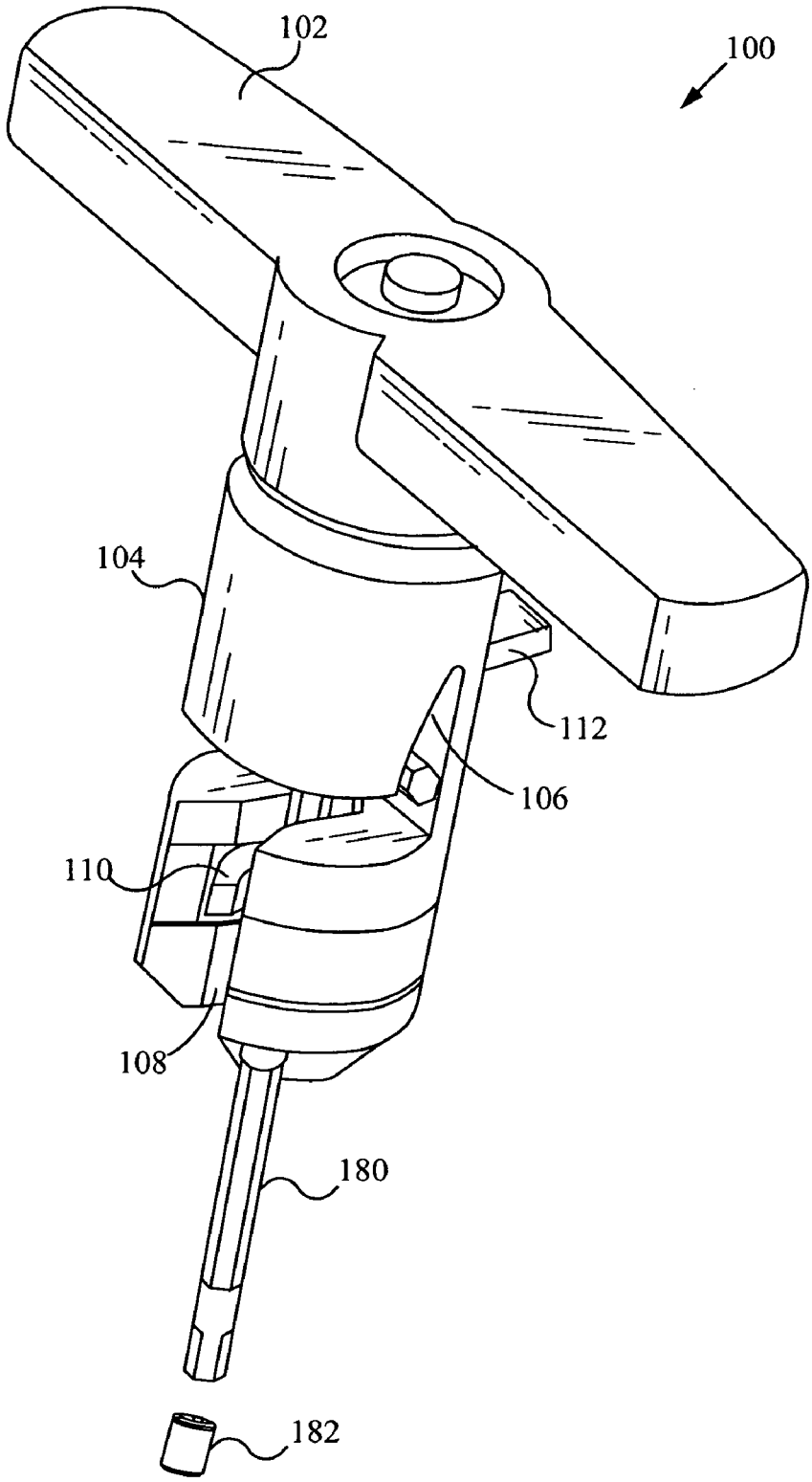
FIG. 7C illustrates a hexagonal socket wrench and corresponding socket with the universal ratcheting tool in accordance with the apparatus of the present invention.

As illustrated in FIGS. 7A, 7B and 7C, the universal ratcheting tool 100 is able to be used with tools other than hexagonal wrenches. A flat screwdriver 160 is able to be used with the universal ratcheting tool 100 by including it on the end of a hexagonal L-shaped bar of a size corresponding to one of the slots, as illustrated in FIG. 7A. A phillips screwdriver 170 is also able to used with the universal ratcheting tool 100 by also including it on the end of a hexagonal L-shaped bar of a size corresponding to one of the slots, as illustrated in FIG. 7B. A socket wrench 180 is also able to be used with the universal ratcheting tool 100 by including it on the end of a hexagonal L-shaped bar of a size corresponding to one of the slots, as illustrated in FIG. 7C. When a socket wrench is held by the universal ratcheting tool 100, sockets 182 of different sizes are then able to be coupled to the socket wrench in order to tighten or loosen nuts and bolts of different sizes. Alternatively, any other appropriate tools are able to be used with the universal ratcheting tool 100.

In some embodiments, the universal ratcheting tool 100 is designed to be utilized with hexagonal wrenches of English sizes including a 9/32 inch hexagonal wrench, a 1/4 inch hexagonal wrench, a 7/32 inch hexagonal wrench, a 3/16 inch hexagonal wrench, a 5/32 inch hexagonal wrench, a 9/64 inch hexagonal wrench, a 1/8 inch hexagonal wrench, a 7/64 inch hexagonal wrench, a 3/32 inch hexagonal wrench and a 5/64 inch hexagonal wrench.

In some embodiments, the universal ratcheting tool 100 is also designed to be utilized with hexagonal wrenches of metric sizes including a 10 mm hexagonal wrench, an 8 mm hexagonal wrench, a 6 mm hexagonal wrench, a 5 mm hexagonal wrench, a 4.5 mm hexagonal wrench, a 4 mm hexagonal wrench, a 3.5 mm hexagonal wrench, a 3 mm hexagonal wrench, a 2.5 mm hexagonal wrench and a 2 mm hexagonal wrench. It should be apparent to one skilled in the art that a universal ratcheting tool 100 is able to be formed to hold fewer, additional or different sizes of hexagonal wrenches.

In some embodiments, the body 104 of the universal ratcheting tool 100 is approximately 3 inches in length. The handle 102 is designed to provide a comfortable, user-friendly interface to a user's hand, in order to enhance a user's ability to exert rotational pressure on the tool 150 without subjecting the user to personal injury or requiring the use of additional tools. As should be apparent to one skilled in the art, the universal ratcheting tool 100 is able to be designed to be of any convenient shape.

The universal ratcheting tool 100 is able to be composed of any appropriate material, which is of maximum strength and includes properties which resist materials that the handle will likely be exposed to, e.g., oil, grease, gasoline and the like. In some embodiments, the universal ratcheting tool 100 is materially composed of 30% glass-filled polycarbonate. In some embodiments, the universal ratcheting tool 100 is materially composed of any suitable composition including, but not limited to aluminum or steel. In some embodiments, the tools 150 are materially composed of aluminum, steel or any other appropriate material.

In some embodiments, the universal ratcheting tool 100 is constructed using an injection molded, core/cavity process as is well known in the art. Alternatively, the universal ratcheting tool 100 is able to be constructed in any known manner.

To utilize a universal ratcheting tool, a tool is positioned within the universal ratcheting tool. The tool is positioned within a first aperture in the universal ratcheting tool. There are slots that shape the first aperture, and the tool fits within one of the slots depending on the size of the tool. The long arm of the tool extends through a second aperture of the universal ratcheting tool for placement in an object such as a screw or a bolt. The tool is retained within the universal ratcheting tool with a retaining component which is opened and closed using a retaining tab. At any time before attempting to turn the object using the universal ratcheting tool, the orientation of the universal ratcheting tool is able to be configured. For example, the universal ratcheting tool is able to be configured to either clockwise or counterclockwise so that the ratchet mechanism allows the tool to be turned in the specified direction which enables the user to either install or remove an object. Once the tool is retained within the universal ratcheting tool, the tool is placed in the object to be turned, and the universal ratcheting tool is turned using the handle. Since the universal ratcheting tool includes a ratcheting mechanism, the user does not need to continuously turn and release the handle. The user's hand is able to remain on the handle, and he is able to turn the handle back and forth with the tool only moving in the desired direction.

In operation, a universal ratcheting tool provides comfort and speed for installing and removing objects such as screws and bolts. A first aperture which is a universal aperture with slots allows many different sized tools to be used by the single universal ratcheting tool. The ratcheting mechanism allows the user to use the tool without having to remove his hand from the handle. A retaining component and a retaining tab retain the tool within the universal ratcheting tool.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A device comprising:

a. a handle non-removably coupled with a body;

b. a plurality of apertures within the body, at least one aperture configured for receiving a tool;

c. an adjustable retaining component coupled to the body for retaining the tool; and d. a ratcheting mechanism within the device for enabling ratcheting movements.

2. The device of claim 1 further comprising one or more directional tabs for configuring orientation of the ratcheting mechanism.

3. The device of claim 1 further comprising a retaining tab for opening and closing the retaining component.

4. The device of claim 1 wherein the aperture includes a plurality of slots configured for receiving a plurality of sizes of tools.

5. The device of claim 1 wherein the retaining component includes at least one arm for retaining the tool.

6. The device of claim 1 wherein the tool includes an elongated rod having a bend through a predetermined angle and including a proximal end for engaging an object, and a mounting end between the bend and a distal end.

7. The device of claim 1 wherein the ratcheting mechanism is located within the handle of the device for enabling ratcheting movements.

8. A device comprising:

a. a handle component;

b. a body component non-removably coupled with the handle component;

c. an aperture within the body component, the aperture configured for receiving a plurality of sizes of tool bodies;

d. an adjustable retaining component coupled with the body component for retaining a tool of the plurality of sizes of tool bodies; and e. a ratcheting mechanism within the handle component for enabling ratcheting movements.

9. The device of claim 8 further comprising one or more directional tabs for configuring orientation of the ratcheting mechanism.

10. The device of claim 8 further comprising a retaining tab for opening and closing the retaining component.

11. The device of claim 8 wherein the aperture includes a plurality of slots configured for receiving the plurality of sizes of tool bodies.

12. The device of claim 8 wherein the retaining component includes at least one arm for retaining the tool.

13. The device of claim 8 wherein the tool includes an elongated rod having a bend through a predetermined angle and including a proximal end for engaging an object, and a mounting end between the bend and a distal end.

14. A device comprising:

a. a handle component sized for a person's hand;

b. a ratcheting mechanism within the handle component for enabling ratcheting movements;

c. a body component coupled with the handle component;

d. a first aperture within the body component, the first aperture configured with a plurality of slots to receive a plurality of sizes of tools;

e. a second aperture within the body component, the second aperture configured to allow a tool of the plurality of sizes of tools to extend out of the body component;

f. a retaining component coupled with the body component for retaining the tool; and g. a retaining tab for opening and closing the retaining component.

15. The device of claim 14 further comprising one or more directional tabs for configuring orientation of the ratcheting mechanism.

16. The device of claim 14 wherein the retaining component includes at least one arm for retaining the tool.

17. The device of claim 14 wherein the tool includes an elongated rod having a bend through a predetermined angle and including a proximal end for engaging an object, and a mounting end between the bend and a distal end.

18. A method of utilizing a universal ratcheting tool comprising:

a. positioning a tool within a first aperture of the universal ratcheting tool, the tool extending through a second aperture of the universal ratcheting tool;

b. retaining the tool within the universal ratcheting tool; and c. turning the universal ratcheting tool while the tool is inserted into an object;

wherein the universal ratcheting tool comprises a handle non-removably coupled with a body.

19. The method of claim 18 further comprising configuring an orientation of the universal ratcheting tool before turning the universal ratcheting tool.

20. The method of claim 18 wherein retaining the tool within the universal ratcheting tool is implemented with a retaining component.

21. The method of claim 18 wherein the first aperture includes a plurality of slots configured for receiving a plurality of sizes of tools.

22. The method of claim 18 wherein the tool includes an elongated rod having a bend through a predetermined angle and including a proximal end for engaging an object, and a mounting end between the bend and a distal end.

* * * * *